US005427222A

United States Patent [19]

Miura et al.

[11] Patent Number: 5,427,222

[45] Date of Patent: Jun. 27, 1995

[54] ARTICLE DELIVERY BOX, AND METHOD OF SUPPLYING ARTICLES USING SAME

[75] Inventors: Toshihiko Miura, Yokohama; Ryohei Yamamoto, Ueno, both of Japan

[73] Assignee: Canon Kabushiki Kaisha, Tokyo, Japan

[21] Appl. No.: 132,194

[22] Filed: Oct. 6, 1993

[30] Foreign Application Priority Data

Oct. 8, 1992 [JP] Japan ..... 4-270367

[51] Int. Cl.[6] ..... B65G 47/00

[52] U.S. Cl. ..... 198/345.3; 198/803.01; 198/803.11; 414/416; 414/786; 220/507; 220/528; 220/533; 220/552; 206/526

[58] Field of Search ..... 198/345.3, 349, 350, 198/465.1, 465.3, 473.1, 803.01, 803.2, 803.11; 414/416, 786; 220/507, 528, 532, 533, 552, 630; 206/216, 493, 526

[56] References Cited

U.S. PATENT DOCUMENTS

| | | | |
|---|---|---|---|
| 3,803,556 | 4/1974 | Duffy | 198/349 |
| 3,854,889 | 12/1974 | Lemelson | 198/349 |
| 4,499,997 | 2/1985 | Swingley | 220/552 |
| 4,705,169 | 11/1987 | Mastronardo | 220/528 |
| 4,757,890 | 7/1988 | Motoda | 198/345.3 |
| 5,255,778 | 10/1993 | Santandrea et al. | 198/345.3 |

FOREIGN PATENT DOCUMENTS

| | | |
|---|---|---|
| 63-21524 | 12/1988 | Japan . |
| 64-45528 | 2/1989 | Japan . |

*Primary Examiner*—Joseph E. Valenza

*Attorney, Agent, or Firm*—Fitzpatrick, Cella, Harper & Scinto

[57] ABSTRACT

An article delivery box for accommodating long articles includes an outer box having a bottom portion, which is formed to include through-holes, and upper side which is open, and a bottom-rest member laid upon a bottom surface of the outer box and formed to have projections that penetrate the through-holes and holding portions for holding lower ends of the articles. An article supply method using this article delivery box includes the steps of supplying article delivery boxes to continuous supplying units for supplying the article delivery boxes to the prescribed working location one box at a time, retaining and positioning the articles relative to the bottom-rest member of the article delivery box by a box supply member having a positioning member for performing positioning by acting upon the projections of the: bottom-rest member, and successively extracting articles by article extracting units after the articles have been positioned and retained.

13 Claims, 11 Drawing Sheets

ARTICLE DELIVERY BOX, AND METHOD OF SUPPLYING ARTICLES USING SAME

BACKGROUND OF THE INVENTION

This invention relates to an article delivery box for supplying articles to a robot apparatus, which performs an operation such as the processing or assembly of the articles, as well as a method of supplying articles using this article delivery box.

A cartridge unit or the like is detachably provided in an image forming apparatus such as a copier, a printer or a facsimile machine. With a view to preserving the global environment, the applicant is having success in reclaiming and reutilizing such cartridge units following their use. The parts constituting such a cartridge unit ordinarily are long articles, the overall length of which is greater than length in the sheet width direction. In order to process or assemble the cartridge unit, therefore, it is required that special consideration be given to supplying the parts for assembly to the working position of the assembling machine, such as the aforementioned robot apparatus.

To this end, an article delivery box 100 of the kind shown in FIG. 11, for example, has been proposed. The article delivery box 100 includes an outer box 101 having a floor accommodating a bottom-rest member 104 for receiving cartridge units P. This article delivery box 100 prevents the cartridge units P from falling over during conveyance.

Since the size of the cartridge unit differs depending upon the type of image forming apparatus, it is required that the article delivery box be so constructed that the cartridge-accommodating size of the bottom-rest member 104 be changed to fit each cartridge unit in order that the outer box 101 may be used as a common component in different cartridge units. However, when the size of the bottom-rest member 104 is changed and the bottom-rest member is placed in the outer box 101, a gap is produced between the outer box 101 and the bottom-rest member 104. As a result, there is a decline in efficiency in terms of the number of articles that can be accommodated in one article delivery box 100.

Japanese Utility Model Application Laid-Open No. 63-21524 (a parts accommodating device) has been proposed in the prior art as a magazine for accommodating elongated articles. According to this prior-art disclosure, a magazine capable of being moved up and down is provided within an article delivery box so that the articles can be lined up and positioned by the magazine.

In order that the magazine can be moved up and down and positioned, the bottom portion of the article: delivery box is provided with a through-hole through which a holder provided on a robot apparatus is passed, and the holder is moved so as to be brought into coincidence with the through-hole. Further, the magazine is provided with an engaging hole for mating with the tip of the holder. Essentially, the magazine is supported by the holder in such a manner that the articles are positioned accurately.

In a case where the articles are long, however, the articles fall over unless the length of engagement between the magazine and the articles is increased. It has been clarified that this makes the article pick-up operation difficult.

SUMMARY OF THE INVENTION

Accordingly, an object of the present invention is to provide an article delivery box of a novel construction for erecting and accommodating long articles, the improvement being such that a large number of articles can be accommodated in the box in an efficient manner.

Another object of the present invention is to provide an article delivery box in which, when long articles are erected and accommodated within the box, the articles will not fall over during conveyance of the box and the articles can be picked up accurately from the box by article extracting means such as a robot.

A further object of the present invention is to provide an article delivery box for conveyance, wherein the box is suited to the conveyance and supply of long articles, namely articles whose length is great in comparison with the width and height of the articles.

Yet another object of the present invention is to provide an article delivery box in which long articles accommodated within the box will not fall over during conveyance to make it difficult for a robot or the like to pick up the articles at the point of supply.

Another object of the present invention is to provide an article supply method in which, when an article delivery box is moved to the box-supply position of a stocker for supplying the article delivery box to article extracting means such as a robot, the box is stopped and held so that the position of an article accommodated within the box is brought to rest accurately at the supply position, thereby assuring the reliability of the article pick-up operation.

Another object of the present invention is to provide an article supply method in which articles accommodated in article delivery boxes can be picked up even when different article delivery boxes are moved to the box-supply position of a stocker for supplying the article delivery boxes to article extracting means, such as a robot.

According to the present invention, the foregoing objects are attained by providing an article supply method for accommodating a plurality of comparatively long articles in an upright attitude and supplying the articles to a prescribed working location. The method comprises a continuous supply step of supplying article delivery boxes to continuous supply means for supplying the article delivery boxes to the prescribed working location one box at a time, wherein each article delivery box includes an outer box having a bottom portion, which is formed to include through-holes, and an upper side which is open, and a bottom-rest member laid upon a bottom surface of the outer box and formed to have projections that penetrate the through-holes and holding portions for holding lower ends of the articles, a positioning and retaining step of retaining and positioning the articles relative to the bottom-rest member of the article delivery box by a box supply member having a positioning member for performing positioning by acting upon the projections of the bottom-rest member, and an extracting step of successively extracting articles by article extracting means after the articles have been positioned and retained.

According to another aspect of the present invention, there is provided an article supply method for accommodating a plurality of comparatively long parts of a cartridge unit, which is used in an image forming apparatus, in an upright attitude and supplying the parts to a prescribed working location. The method comprises a continuous supply step of supplying article delivery boxes to continuous supply means for supplying the article delivery boxes to the prescribed working location one box at a time, wherein each article delivery box includes an outer box having a bottom portion, which is formed to include through-holes, and an upper side which is open, and a bottom-rest member laid upon a bottom surface of the outer box and formed to have projections that penetrate the through-holes and holding portions for holding lower ends of the comparatively long parts, a positioning and retaining step of retaining and positioning the comparatively long parts relative to the bottom-rest member of the article delivery box by a box supply member having a positioning member for performing positioning by acting upon the projections of the bottom-rest member, and an extracting step of successively extracting the comparatively long parts by article extracting means after the parts have been positioned and held.

According to the present invention, the foregoing objects are attained by providing an article delivery box for accommodating a plurality of comparatively long articles in an upright attitude and supplying the articles to a prescribed working location, comprising an outer box having a bottom portion, which is formed to include through-holes, and an upper side which is open, a bottom-rest member laid upon a bottom surface of the outer box and formed to have projections that penetrate the through-holes and holding portions for holding lower ends of the articles, partitioning members for partitioning the articles individually within the outer box, and an upper-end supporting member, which has grooves for holding the partitioning members at a prescribed equidistant spacing, attached to an inner peripheral wall of the outer box.

According to another aspect of the present invention, there is provided an article delivery box for accommodating a plurality of comparatively long parts of a cartridge unit, which is used in an image forming apparatus, in an upright attitude and supplying the parts to a prescribed working location, comprising an outer box consisting of a resin material and having a bottom portion, which is formed to include through-holes, and an upper side which is open, a bottom-rest member, which consists of a prescribed resilient body, laid upon a bottom surface of the outer box so as to be free to move up and down and formed to have projections that penetrate the through-holes and holding portions for holding lower ends of the comparatively long parts, partitioning members for partitioning the comparatively long parts individually within the outer box, and an upper-end supporting member, which has grooves for retaining the partitioning members at a prescribed equidistant spacing, attached to an inner peripheral wall of the outer box in a freely detachable manner.

According to another aspect of the present invention, there is provided an article supply method for supplying different article delivery boxes, each of which accommodates a plurality of articles, to a prescribed working location of a robot apparatus. The method comprises a continuous supply step of continuously supplying article delivery boxes that differ from one another to continuous supply means for supplying the boxes to the prescribed working location one box at a time, each article delivery box including an outer box having a bottom portion formed to include through-holes of a pitch that differs from one article delivery box to another and an upper side which is open, and a bottom-rest member laid upon a bottom surface of the outer box and formed to have projections that penetrate the through-holes and holding portions for holding lower ends of the articles, a box discriminating step of discriminating the type of article delivery box, a positioning and retaining step of positioning and retaining the articles relative to the bottom-rest member of the article delivery box by a box supply member having pitch changing means for changing pitch spacing in dependence upon the pitch of the projections of the bottom-rest member, and an extracting step of successively extracting the articles by the robot apparatus after the articles have been positioned and retained.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Embodiments of the present invention will now be described in detail with reference to the drawings.

[First Embodiment ]

Figure 1:
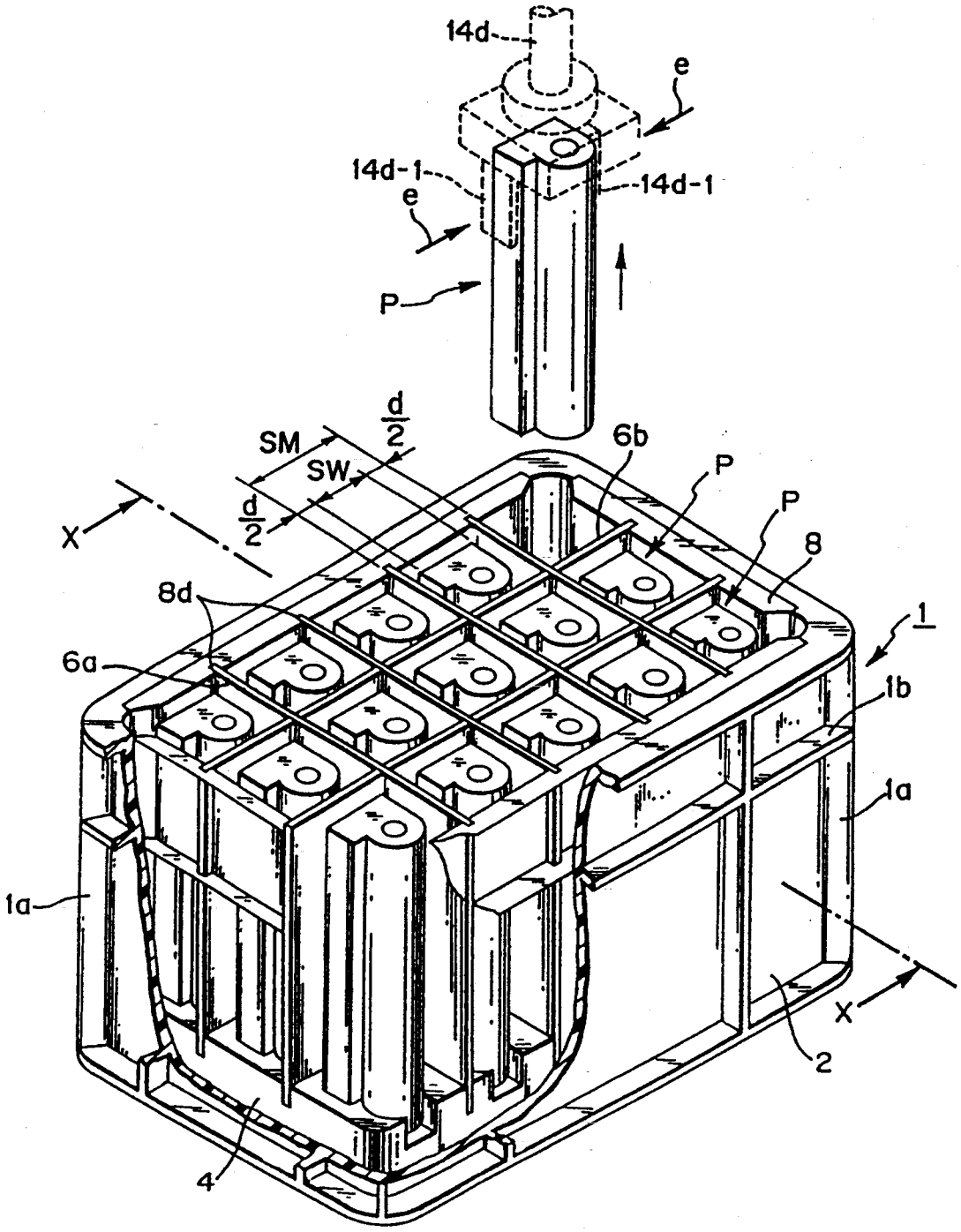
FIG. 1 is an external perspective view, partially broken away, illustrating an article delivery box according to a first embodiment of the present invention.
Figure 4:
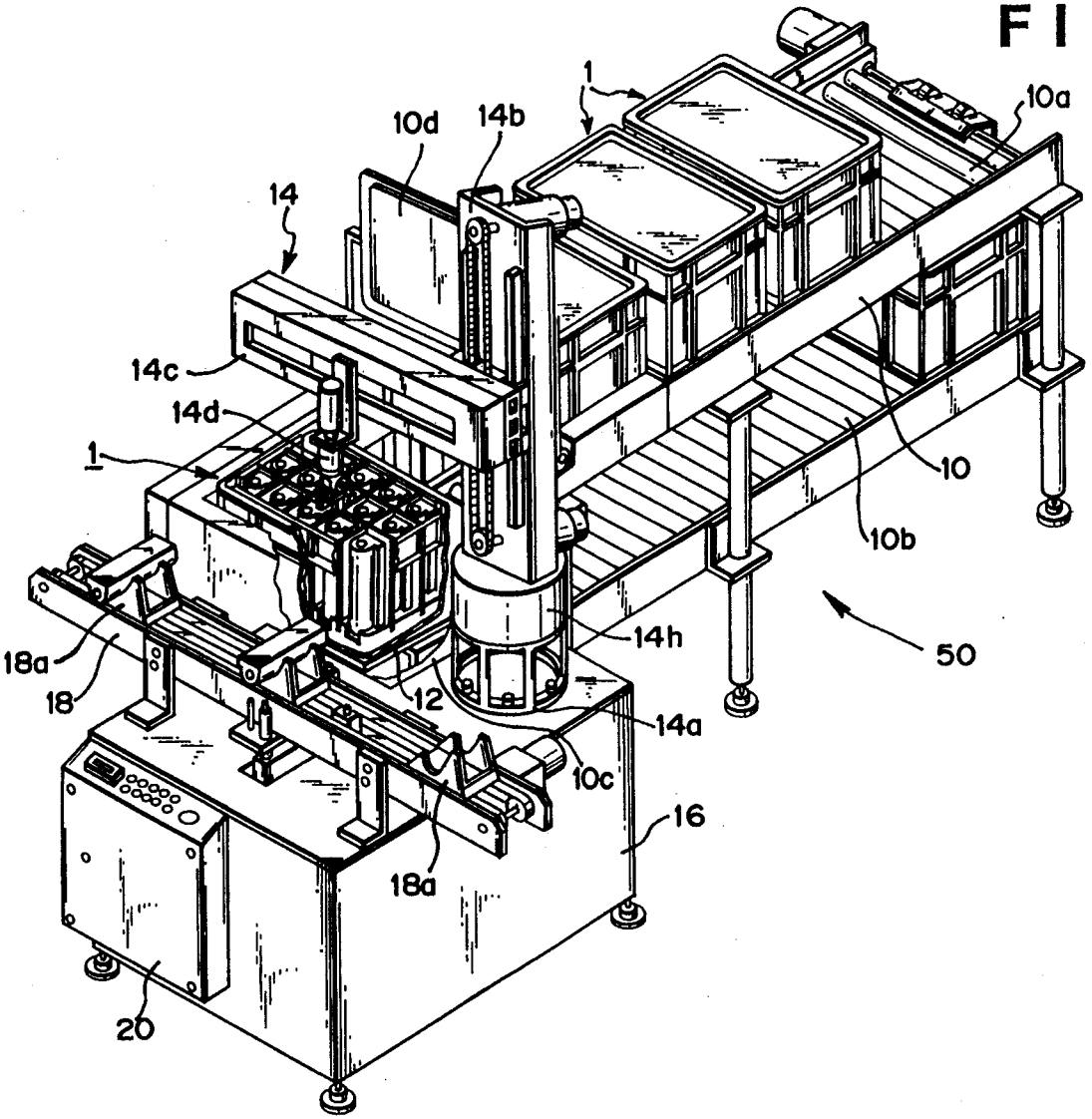
FIG. 4 is an external perspective view showing an article conveyance and supply apparatus along with article delivery boxes.

FIG. 1 is an external perspective view illustrating an article delivery box 1 according to a first embodiment of the present invention. A portion of the article delivery box 1 is shown broken away to illustrate the manner in which a plurality of articles P are accommodated in an upright attitude within the box. The articles P are accommodated in such a manner that they can be picked up by a robot hand 14*d* of a robot 14 (FIG. 4).

Figure 2:
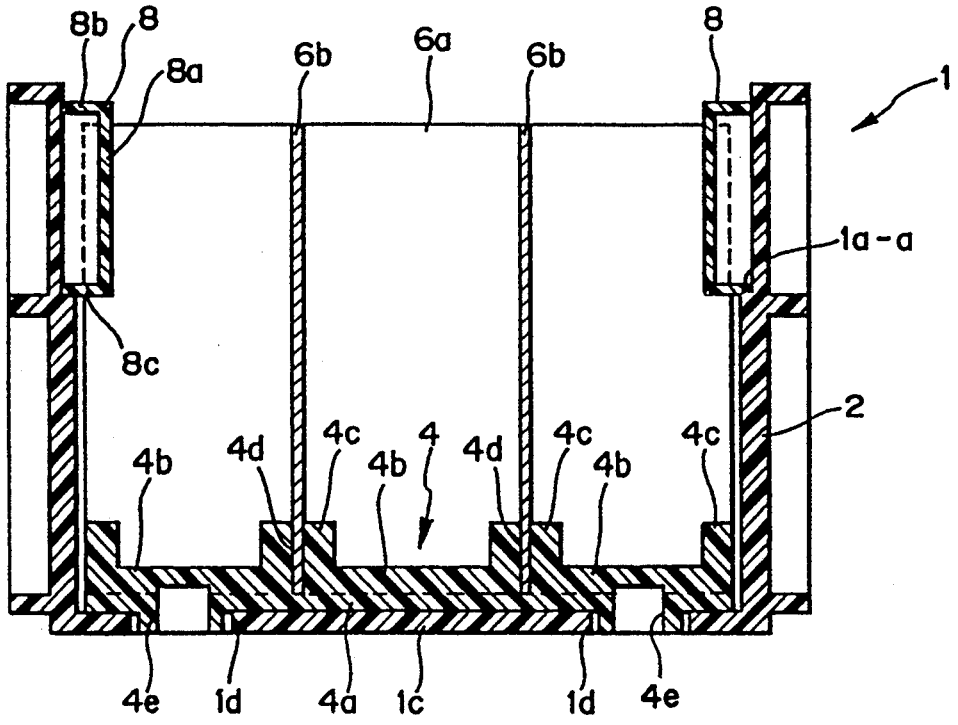
FIG. 2 is a sectional view taken along line X—X of FIG. 1.

As shown also in FIG. 2, which is a sectional view taken along line X—X of FIG. 1, the article delivery box 1 includes an outer box 2 and a bottom-rest member 4. The outer case 2 is manufactured by injection molding a plastic material, for example, and has a peripheral wall formed to include a plurality of longitudinal ribs 1*a* and a plurality of horizontal ribs 1*b* at a prescribed pitch. This grid-shaped configuration provides strength and assures the flowability of the plastic material at the time of injection molding.

The outer box further includes a bottom portion 1*c* formed to have a plurality of openings 1*d* in the form of through-holes. The bottom-rest member 4, which is made of a material that is soft and exhibits some flexibility, such as Styrofoam, has a bottom portion 4*a* laid upon the bottom of the outer box 2. The upper surface of the bottom portion 4*a* is formed to have a plurality of generally U-shaped article accommodating portions 4*b* for accommodating the articles P. The accommodating portions 4*b* are spaced apart from one another approximately equidistantly and are capable of receiving, in an upright attitude, the comparatively long articles P, such as cartridge units of an image forming apparatus. Furthermore, the accommodating portions 4*b* are designed to have an inner diameter and a depth that will allow one end of each cartridge unit P to be press-fitted slightly into the corresponding accommodating port ion.

A plurality of protrusions 4*c* formed between the article accommodating portions 4*b* of the bottom-rest member 4 are each formed to have grooves 4*d* for retaining partitioning members 6*a*, 6*b*. Further, the bottom surface of the bottom-rest member 4 is formed to have holes 4*e* functioning as positioning engagement portions, described later. The partitioning members 6*a* and 6*b* are arranged along X and Y axes, respectively, so as to partition the interior of the outer box 2 into square compartments, as best illustrated in FIG. 1.

The upper portion of peripheral wall of the outer box 2 is provided with an upper-end supporting member 8 for preventing the articles from falling over. The upper-end supporting member 8 is formed to have a flat portion 8*a* along the inner peripheral surface of the outer box 2, and bent portions 8*b*, 8*c* obtained by bending the upper and lower ends of the flat portion 8*a*. The lower bent portion 8*c* is so provided as to abut against and engage with a step 1*a*—*a* on the inner side of each vertical rib 1*a* of the outer box.

The flat portion 8*a* of the upper-end support member 8 is formed to have a plurality of approximately equally spaced vertical grooves 8*d*, as shown in FIG. 1, into which the partitioning members 6*a*, 6*b* are fitted in order to be retained in the X and Y directions, respectively. Thus, the partitioning portions 6*a*, 6*b* are secured and prevented from dislodging from the upper-end support member 8.

Figure 3:
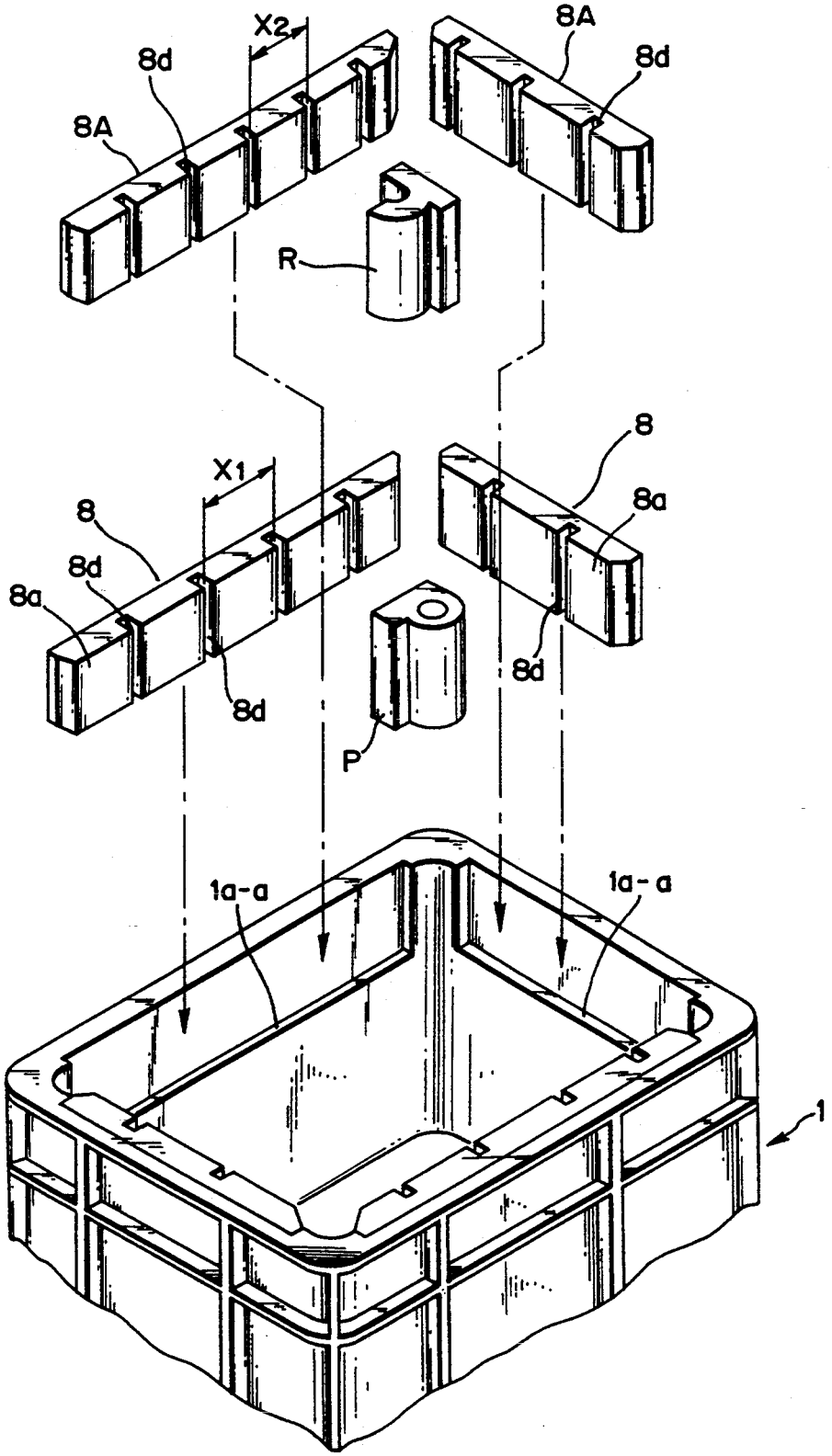
FIG. 3 is an external perspective view showing another example of the construction of an upper-end support member.

FIG. 3 is a perspective, exploded view showing a modification of the upper-end supporting member 8. As shown in FIG. 3, a plurality of upper-end supporting members 8, 8A in which the spacing between the grooves 8*d* formed in the flat portions 8*a* thereof differ from one supporting member to another are prepared in advance, and the partitioning members 6*a*, 6*b* are set in the upper-end holding portions 8, 8A in conformity with the external sizes of articles P, R to be accommodated. This makes it possible to change the partitioning spacing, shown at Xn in FIG. 3. More specifically, the supporting member 8 in FIG. 3 is that for accommodating a first article P. The spacing of the vertical grooves 8*d* in the supporting member 8 is set at X1. A supporting member 8A shown above the supporting member 8 is that for a case in which a second article R, which is different from the first article P, is to be accommodated. The spacing of the vertical grooves 8*d* in the supporting 8A is set at X2. This spacing is so decided as to match the external size of the second article R.

In sum, therefore, the article delivery box 1 comprises the outer box 2, the bottom-rest member 4, the partitioning members 6*a*, 6*b* and the upper-end supporting member 8. Article accommodating portions in the form of square compartments are delimited within the article delivery box.

The cartridge units P are placed in the article delivery box 1, which is constructed as set forth above, and the lower ends of the cartridge units P are inserted into the recessed article accommodating portions 4*b* of the bottom-rest member 4. As a result of inserting these cartridge units P in this manner, the cartridge units P inserted in the individual accommodating portions 4*b* of the article delivery box 1 assume an upstanding attitude in which they are received, to a prescribed depth, in the accommodating portions 4*b* of the bottom-rest member 4. Let $S_M$ represent the distance between the inner walls of the partitioning members 6*a*, and let $S_w$ represent the width of each cartridge unit P. The gap between both side walls of the cartridge unit P and the partitioning members will then be d/2. Since the dimension d/2 can be utilized as a space that allows insertion of two fingers 14*d*-1 of the robot hand 14*d* serving as means for extracting the cartridge units, each cartridge unit can be grasped by moving the two fingers 14*d*-1 in the directions of the arrows e after they have been inserted, as shown in FIG. 1.

Further, vacuum attracting means may be mounted on the robot hand 14*d* for holding the cartridge units by suction.

The article delivery box 1 can be placed on a well-known unmanned vehicle, inserted into the storage rack of a well-known stocker to be utilized in the conveyance and supply of articles. For example, the article delivery box 1 can be used instead of a pallet described in the specification of Japanese Patent Application No. 62-271221 (Japanese Patent Application Laid-Open No. 64-45528) filed earlier by the present applicant. Furthermore, the article delivery box 1 is capable; of stably maintaining the attitude of the accommodated articles P owing to the action of the upper-end support member 8, which assures that the free ends of the accommodated articles P will remain upright.

Next, an embodiment of a method of conveying and supplying articles will be described with reference to the external perspective view of FIG. 4, which shows an article conveyance and supply apparatus 50 along with the article delivery boxes 1, and the sectional view of FIG. 5, which illustrates the principal portions of the article delivery box 1.

As shown in FIG. 4, a stocker 10 is arranged above the rear portion of the article conveyance and supply apparatus 50 and includes a first conveyor 10*a* on which are placed a plurality of the article delivery boxes 1 each accommodating a number of the articles P, and a second conveyor 10*b*, disposed below the first conveyor 10*a*, on which emptied article delivery boxes 1 are placed.

The front end of the stocker 10 thus constructed is provided with a box supply platform 10*c* for conveying the article delivery boxes 1 accommodating the articles P to the box supply position of the robot apparatus 14, and an elevator 10*d* for transporting the article delivery boxes 1 accommodating the articles P to the box supply platform 10c and transporting emptied article delivery boxes on the supply platform to the second conveyor 10b.

Figure 5:
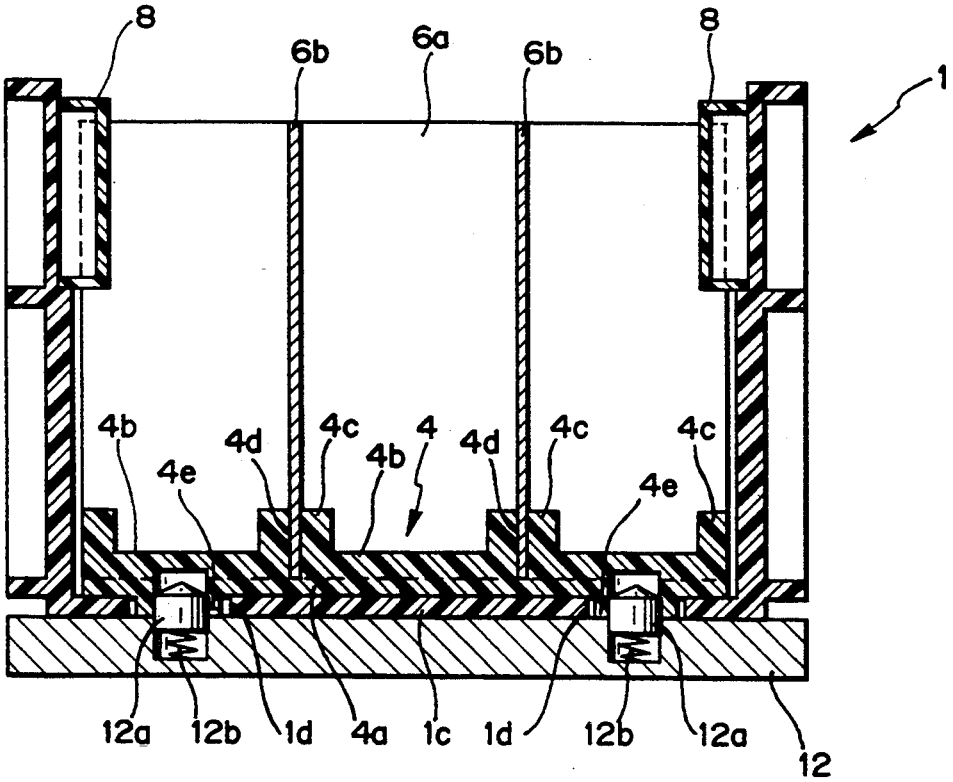
FIG. 5 is a sectional view showing the corresponding relationship between the article delivery box and a positioning member.

Furthermore, a box positioning member 12 constituting box positioning means shown in FIG. 5 is attached to the box supply platform 10c. The box positioning member 12 comprises a plate-shaped member having substantially the same length and width dimensions as the outer box 2 constituting the article delivery box 1. The upper surface of the box positioning member 12 is provided with engaging pins 12a serving as projections that mate with the holes 4e formed in the bottom of the bottom-rest member 4 laid on the floor of the article delivery box 1.

As shown in FIG. 5, the engaging pins 12a are subjected to an upwardly acting spring force by spring members 12b. The positioning member 12 attached to the box supply platform 10c is for positioning the article delivery boxes correctly relative to the article pick-up position of the robot apparatus 14.

A work bench 16 for performing such work as processing and assembly of the articles is provided on the floor in front of the article conveyance and supply apparatus 50. The robot apparatus 14 has a base portion 14a secured to a flat portion 16a of the work bench 16. The robot apparatus 14 comprises a rotary portion 14h rotated relative to the base portion 14a, a Z-axis arm 14b fixed to the rotary portion 14h and driven up and down, a Y-axis arm 14c driven on the Z-axis arm 14b, and the movable finger unit 14d driven on the Y-axis arm 14c.

A work conveyor 18 is arranged on the work bench 16 at the front end thereof. Mounted on the work conveyor 18 are a plurality of working units 18a for processing and assembling the articles P. The front end face of the work bench 16 is provided with a control panel 20.

A method of supplying articles using the article conveyance and supply apparatus 50 and the article delivery boxes 1 will now be described.

First, the article delivery boxes 1 are carried to the first conveyor 10a of the stocker 10 by the unmanned conveyance vehicle (not shown) on which a plurality of article delivery boxes 1 accommodating articles P are stacked. Next, the article delivery boxes 1 are successively arranged in a row on the first conveyor 10a, after which the boxes are fed in the direction of the box supply platform 10c provided at the end of the conveyor. An article delivery box 1 that has been sent to the box supply platform 10c is situated on the positioning member 12 secured to the platform 10c, as a result of which the engaging members 12a of the positioning member 12 mate with the engaging holes 4e of the bottom-rest member 4 in the article delivery box 1.

When the engaging members 12a of the positioning member 12 thus mate with the engaging holes 4e of the bottom-rest member 4, the plurality of articles P accommodated in the article delivery box 1, while being retained and positioned in the accommodating recesses 4b of the bottom-rest member 4, have their upper ends positioned by the upper-end supporting member 8. As a result, the position of each article P in the article delivery box 1 on the box supply platform 10c is set in accurate fashion.

Meanwhile, the finger unit 14d of the robot apparatus 14 is taught the paths of movement of pick-up points along the X and Y axes (not shown) above the box supply platform 10.

Accordingly, when an article delivery box 1 is shifted onto the supply platform 10c, the positional relationship between the robot finger unit 14d and each article P in the article delivery box 1 will be as decided in accordance with what the finger unit was taught. Further, in accordance with the teaching operation, the fingers 14d-1 penetrate as allowed by the aforementioned dimension d/2, grasp an article P, pick up the article from within the article delivery box 1, shift it onto the work bench 16 and perform an operation such as processing or assembly on the work bench 16.

A controller incorporated within the control panel 20 controls the robot apparatus 14, the stocker 10 and the elevator 10d and is provided with detecting means for detecting the position of the article delivery boxes 1 and whether or not a box 1 is present. Furthermore, the controller is provided with a counter for counting the number of times the articles are picked up by the robot apparatus.

Accordingly, it is possible to count the number of times the articles P in an article delivery box 1 on the box supply platform 10c are picked up. When the article delivery box 1 is eventually emptied of its articles P, the emptied article delivery box 1 is shifted onto the second conveyor 10b of the stocker 10 by the elevator 10d and is fed toward an empty-box discharge port by the conveyor 10b.

The next article delivery box 1 on which articles have been stacked is fed to the box supply platform 10c by the first conveyor 10a and the aforementioned pick-up operation is performed again by the robot apparatus 14.

[Modification of positioning of box supply platform]

The positioning means of the box supply platform shown in FIG. 4 is realized by the positioning member 12. The engaging members 12a of the positioning member 12 shown in FIG. 4 mate with the engaging holes 4e of the bottom-rest member 12 so that the mutual relationship between the engaging members 12a and the engaging holes 4e is fixed.

An arrangement may be adopted in which a plurality of the engaging members 12a that engage with the bottom-rest member 4 are provided at positions where they may engage with any engaging holes of the bottom-rest member, and each engaging member can be driven electromagnetically, for example, thereby making it possible for the same apparatus to be used commonly for different types of boxes.

[Description of Application]

Figure 6:
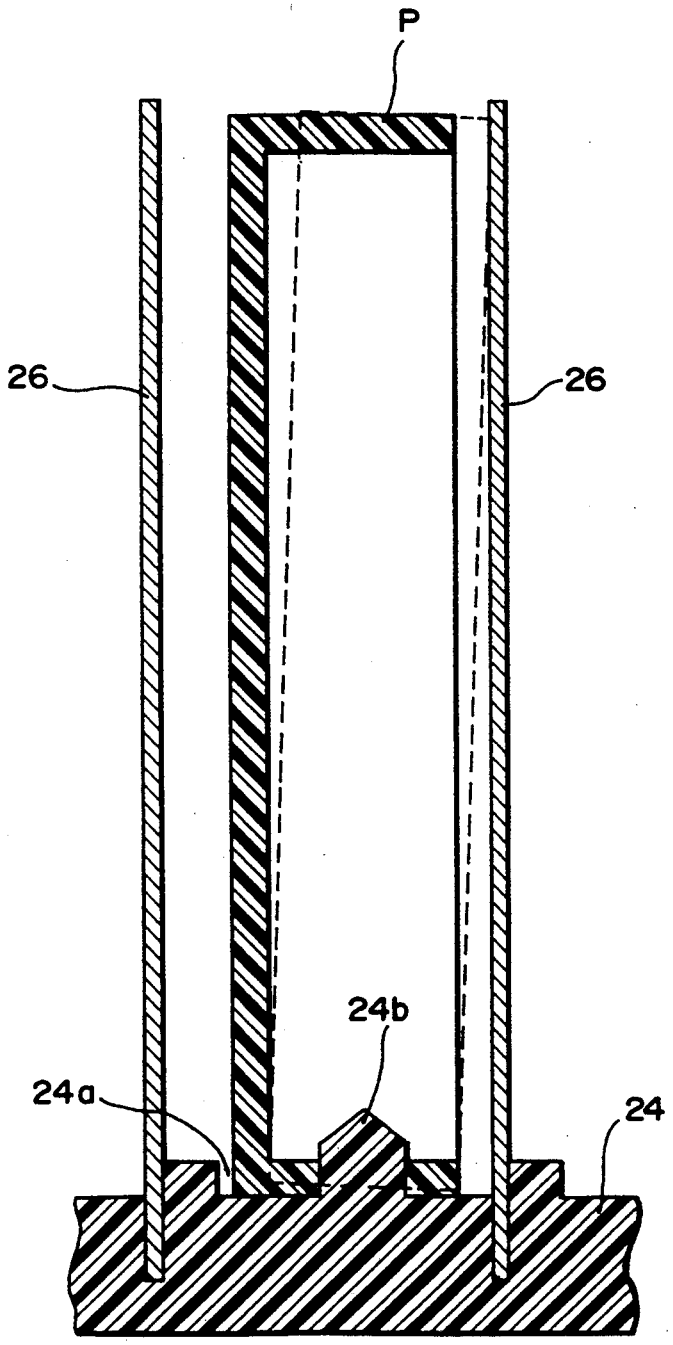
FIG. 6 is a sectional view illustrating an example of application of the article delivery box.

FIG. 6 is a sectional view illustrating the principal portions of an application of an article delivery box. FIG. 6 illustrates the manner in which the article delivery box 1 solves a problem, encountered in the pick-up operation performed by the robot apparatus at the supply position, caused by toppling or tilting of the articles P during conveyance of the articles in the box 1.

FIG. 6 shows only the relationship between a bottom-rest member 24 and partitioning members 26. The outer box and the upper-end support member are constructed in the same manner as illustrated in FIGS. 1 through 5. In FIG. 6, the bottom-rest member 24 is made of a flexible material such as urethane foam and the upper surface thereof is formed to have a recessed accommodating portion 24a for receiving the lower portion of an article A. The recessed accommodating portion 24a is provided with a projection 24b. When the lower portion of the article is inserted into the recessed accommodating portion 24a, the projection 24b fits into a recess located in the bottom surface of the article.

The article delivery box of this embodiment is constructed by laying the bottom-rest member 24 shown in FIG. 6 in the outer box and installing the partitioning members and the upper-end supporting member. Accordingly, when articles are placed within the article delivery box and the box is conveyed, the accommodated articles may fall over or tilt, as indicated by the dashed lines in FIG. 6, owing to tilting of the article delivery box during conveyance. In such case, the articles are restored to the normal attitude, as indicated by the arrow in FIG. 6, owing to the face that the projection 24b on the bottom-rest member within the article delivery box is fitted into the bottom of the article.

In the arrangement shown in FIG. 6, the restoring action is assisted by providing some clearance between the article and the recessed accommodating portion 24a of the bottom-rest member.

Thus, as described above, the article delivery box according to the present invention is so adapted that a common size is adopted for the outer box while a bottom-rest member and partitioning members are prepared in conformity with the type of article, whereby the article delivery box can be made to accommodate articles of a variety of types. Further, even long articles can be conveyed and supplied while being maintained in a correct attitude by the action of the upper-end supporting member 8 that supports the upper ends of the articles. This makes it possible to avoid pick-up errors by the robot.

Further, an article delivery box having an article accommodating body that can be detached and replaced in dependence upon the type of article accommodated is supplied to a stocker that supplies the article delivery box to a position at which the box is supplied to article extracting means such as a robot, and articles that have been accommodated within the accommodating body are supplied upon being positioned at the article pick-up position of the article extracting means irrespective of the type article accommodating body. As a result, the articles can be supplied to the supply position correctly.

Furthermore, in accordance with the present invention, if the articles that have been received in the bottom-rest member fall over or tilt within the accommodating body, the articles are restored to their normal attitude. This makes it possible to supply the articles accurately.

It should be noted that the present invention is not limited to the above-described embodiment. For example, the articles are not limited to the cartridge units P. In addition, the construction of the article conveyance and supply apparatus 50 is not limited, to the above-described construction as a matter of course.

[Second Embodiment ]

A second embodiment of the invention will now be described with reference to FIGS. 7 through 10.

Figure 9:
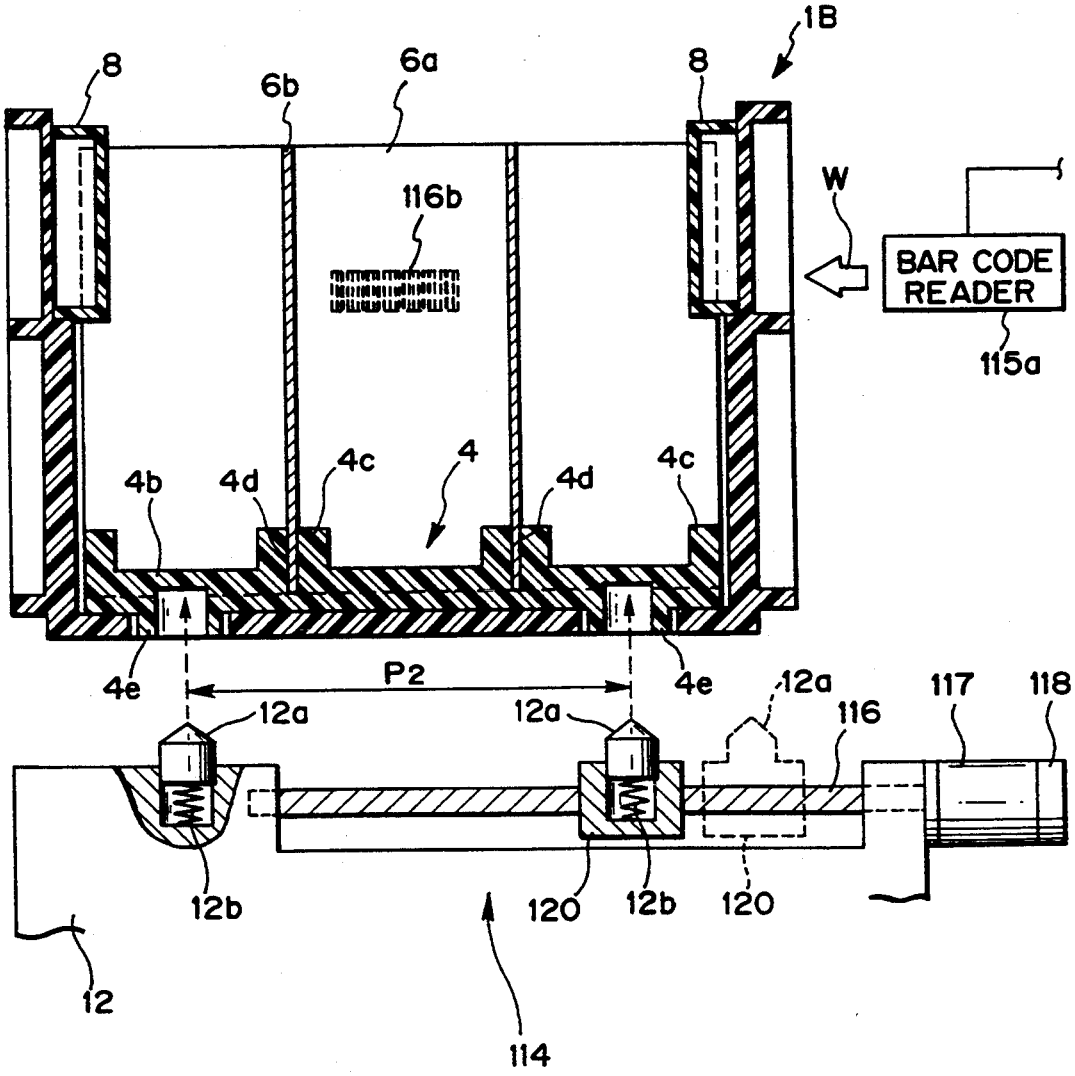
FIG. 9 is a view for describing the operation of the pitch changing means.

First, as shown in FIG. 9, the conveyance and supply apparatus 50 of FIG. 4 is provided with a plurality of robot apparatus 14 (only one is shown in FIG. 4). The robot apparatus 14 is adapted to pick up only the articles P, which are accommodated in a prescribed article delivery box 1, in response to a command signal sent from an article-supply control unit 110 provided in the article conveyance and supply apparatus 50. More specifically, the arrangement is such that articles are picked up solely from the article delivery boxes sent to the positions of the box positioning members 12 corresponding to the plurality of robot apparatus 14. Consequently, the article delivery boxes 1 are so constructed as to have a different pitch Pn between the holes 4e of the bottom-rest member 4 in dependence upon each type of article accommodated.

Figure 7:
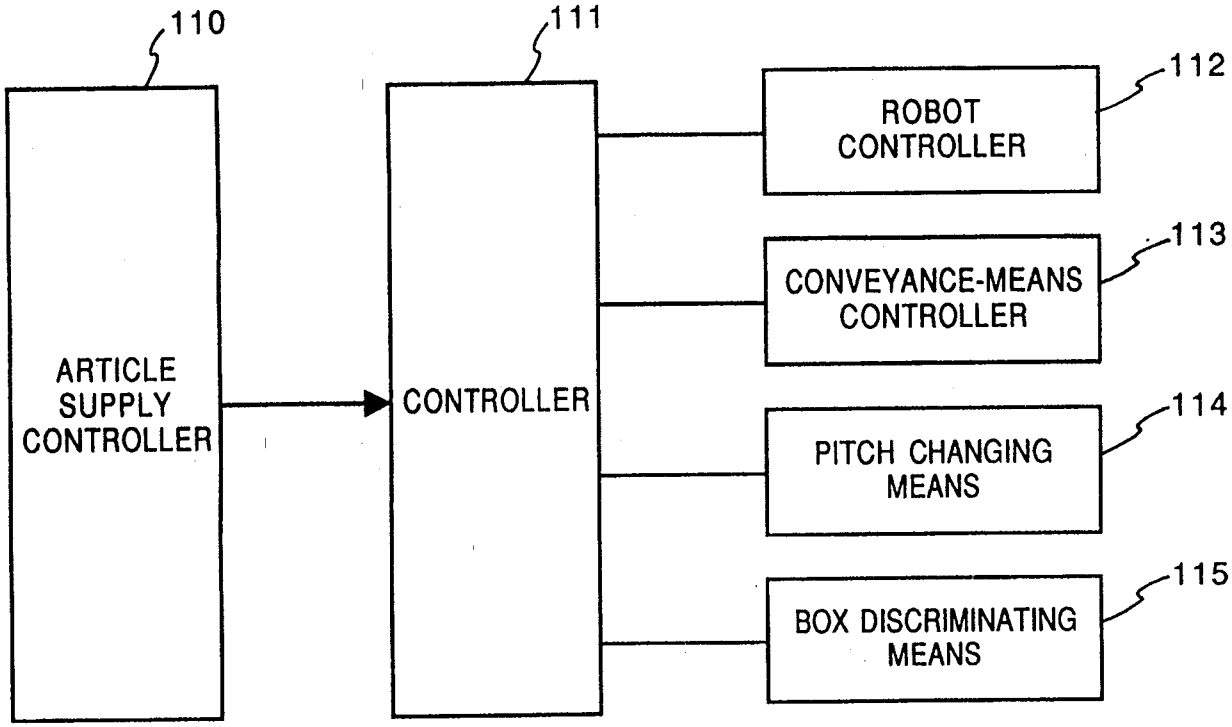
FIG. 7 is a block diagram illustrating an article conveyance and supply apparatus according to a second embodiment of the present invention.

As shown in the block diagram of FIG. 7, a controller 111 is connected to the article-supply control unit 110, a robot controller 112 for controlling the robot apparatus 14, a conveyance-means controller 113 for controlling the drive of the stocker 10, pitch changing means 114 for varying the pitch between the plurality of engaging pins 12a provided to conform to the pitch Pn of the holes 4e in the bottom-rest member 4, and box discriminating means 115 for discriminating the type of article delivery box 1.

Figure 8:
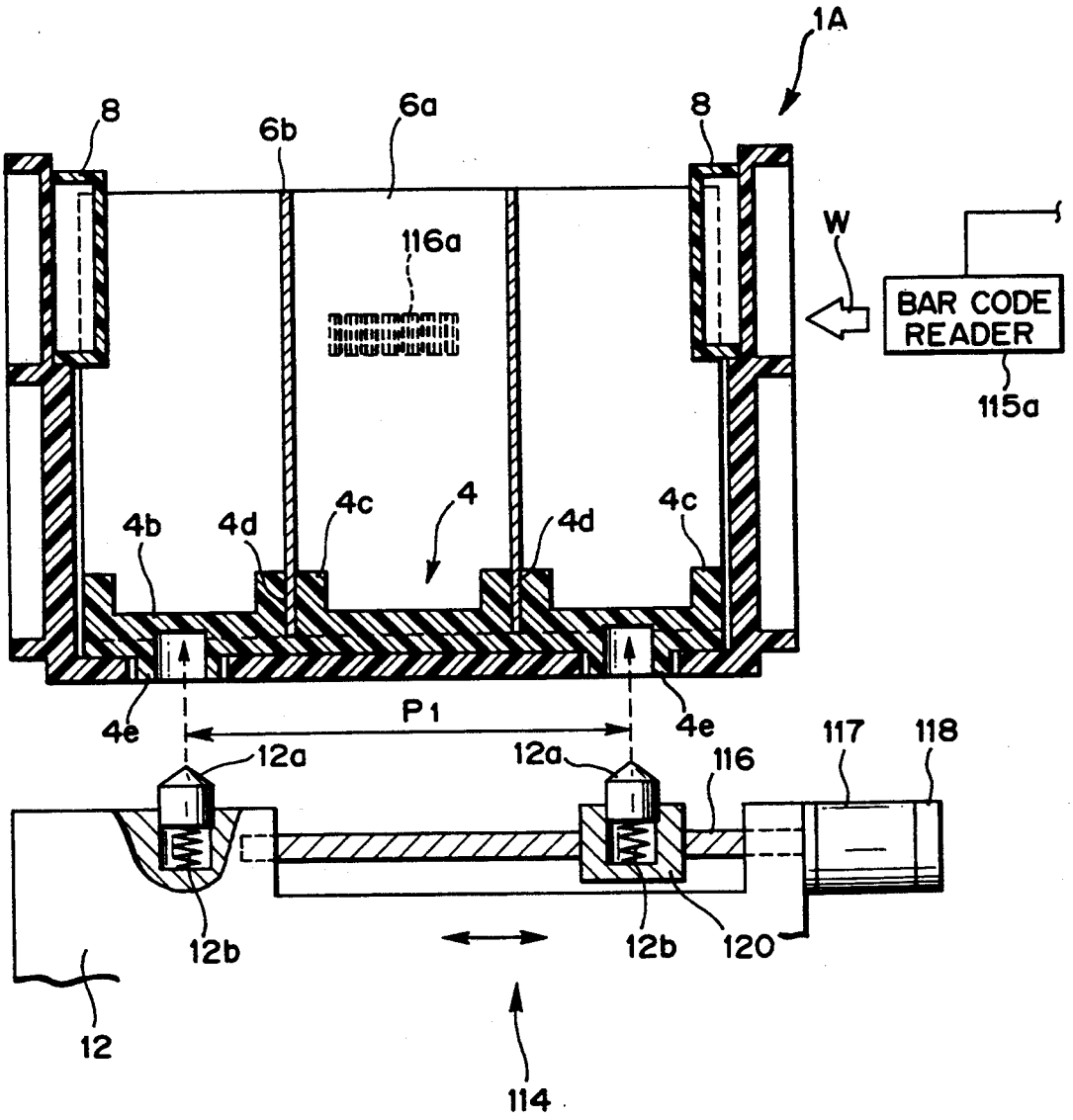
FIG. 8 is a sectional side view illustrating the construction of a pitch changing device along with an article delivery box.

As shown in FIG. 8, the box discriminating means 115 comprises a bar code reader 115a for reading a bar code 116a, indicated by the broken lines in FIG. 8, affixed to the side of an article delivery box 1A at a prescribed height. The arrangement is such that the bar code 116a on the side of the article delivery box 1A is read during the conveyance of the box on the conveyor 10a toward the box positioning member 12 in the direction of arrow W.

The pitch changing means 114, which employs the box positioning member 12 as a base, has one engaging pin 12a provided in the manner described above and another engaging pin 12a provided so as to be movable. In order to achieve this freely movable arrangement, a lead screw 116 is provided on one output shaft and a stepping motor 117 to which a rotary encoder 118 is secured is fixed the other output shaft at the side of the box positioning member 12. The movable engaging pin 12a is provided, in a state biased by the spring 12b, on a carriage 120 engaged with the lead screw 116 and moved in the direction of the arrows in FIG. 8.

Owing to the construction of the pitch changing means 114, the carriage 120 is positionally controlled in such a manner that the pair of engaging pins 12a are moved to positions corresponding to the pitch P1 between the holes 4e of the bottom-rest member 4, which replaced to conform to the type of articles P accommodated.

In FIG. 9, a bar code 116b indicated by the broken lines is affixed to an article delivery box 1B, which is smaller than the article delivery box 1A shown in FIG. 8, at a position having the same height as that of the bar code on the article delivery box 1A. The bar code 116b on the side of the article delivery box 1B is read by the bar code reader 115a during the conveyance of the box on the conveyor 10a toward the box positioning member 12 in the direction of arrow W.

The pitch P2 between the holes 4e in the bottom-rest member 4 provided on the bottom of this smaller article delivery box 1B is set to be smaller than the pitch P1 of the article delivery box 1A. In order to retain the article delivery box 1B on the box positioning member 12, the stepping motor 117 is driven to move the engaging pin 12a carried on the carriage 120 from the position indicated by the dashed lines to the position indicated by the solid lines. When the stepping motor 117 is driven, the amount of rotation thereof is monitored by the rotary encoder 118 and the amount of rotation of the lead screw 116 is controlled to make the pitch between the engaging pins 12a match the pitch P2 between the holes 4e in the bottom-rest member 4.

By thus controlling the position of the carriage 120, the pair of engaging pins 12*a* can be moved to the positions that correspond to the pitch Pn between the holes 4*e* of the bottom-rest member 4, which is replaced to conform to the type of articles P accommodated.

Figure 10:
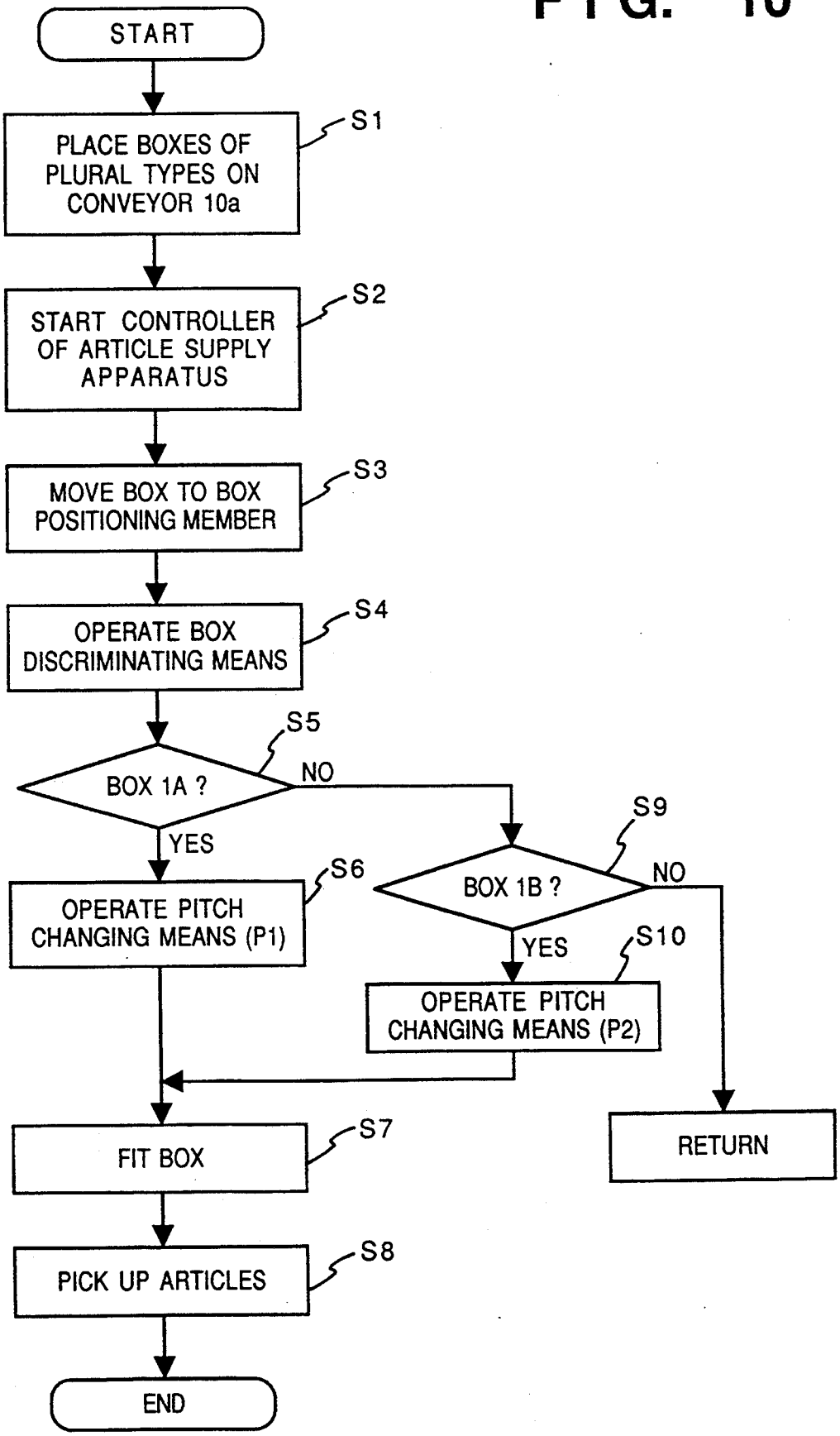
FIG. 10 is a flowchart for describing the operation of the-pitch changing means.
Figure 11:
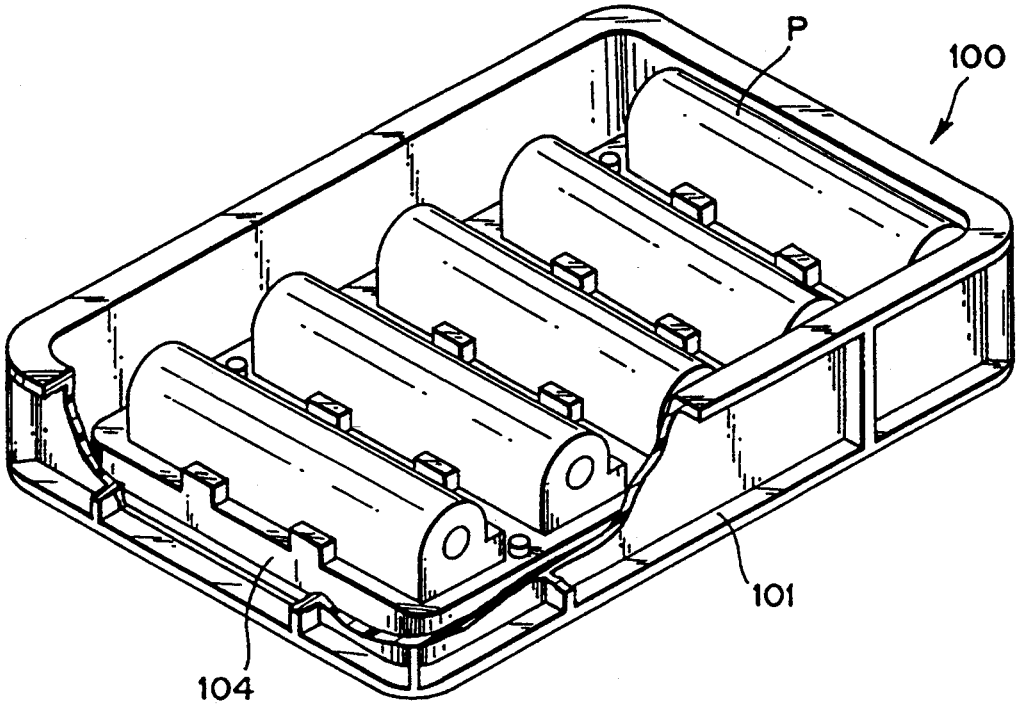
FIG. 11 PRIOR ART
FIG. 11 is an external perspective view, partially broken away, showing an article delivery box according to the prior art.

The operation of the second embodiment constructed as set forth above will now be described in accordance with the flowchart of FIG. 10. When the article conveyance and supply apparatus 50 is started, the article delivery boxes 1A, 1B are placed upon the conveyor 10*a* in a randomly mixed state at step S1. Next, at step S2, the controller 111 of the article conveyance and supply apparatus 50 is started, after which the conveyor 10*a* is started at step S3 to convey the mixed article delivery boxes to the box positioning member 12.

In the course of conveyance, the reading of the bar codes 116*a*, 116*b* by the bar code reader 115*a*, which serves as the box discriminating means, is executed at step S4. Next, it is determined at step S5 whether the article delivery box is the box A. If determination made at step S5 is YES, then the driving of the pitch changing means 114 is executed at step S6 so as to match the pitch P1 between the holes 4e of the bottom-rest member 4 of the article delivery box 1A. This is followed by raising the box positioning member 12, in the manner described earlier, and securing the article delivery box 1A (step S7). As a result, the article delivery box 1A can be positioned accurately relative to the robot apparatus 14. The prescribed articles are then picked up and extracted at step S8. The processing of one article delivery box ends when the box has been emptied.

If it is determined as step S5 that the article delivery box is not the box 1A, then it is determined at step S9 whether the article delivery box is the box 1B. If the answer here is YES, then the pitch changing means 114 is driven at step S10 so as to match the pitch P2 between the holes 4*e* of the bottom-rest member 4 of the article delivery box 1B. This is followed by raising the box positioning member 12, in the manner described earlier, and securing the article delivery box 1B at step S7. As a result, the article delivery box 1B can be positioned accurately relative to the robot apparatus 14. The prescribed articles are then picked up and extracted at step S8. If it is found at step S9 that the article delivery box is not the box 1B, then either an error decision is rendered or a flag is raised to indicate that the article delivery box is neither the box 1A nor the box 1B. The program returns from step S9.

Following the return, a judgment can be rendered to the effect that the article delivery box is other than the box 1A and 1B, and the pitch changing means 114 can be driven to set an engaging-pin pitch conforming to the desired pitch Pn, in the manner described above, thereby making it possible to deal with article delivery boxes other than the boxes 1A and 1B.

As many apparently widely different embodiments of the present invention can be made without departing from the spirit and scope thereof, it is to be understood that the invention is not limited to the specific embodiments thereof except as defined in the appended claims.

What is claimed is:

1. An article supply method using an article delivery box for accommodating a plurality of comparatively long articles in an upright attitude and supplying the articles to a prescribed working location, said method comprising the steps of:

supplying article delivery boxes to continuous supply means for supplying the article delivery boxes to the prescribed working location one box at a time, wherein each article delivery box includes an outer box having a bottom portion, which is formed to include through-holes and an upper side which is open, and a bottom-rest member laid upon a bottom surface of the outer box and formed to have projections that penetrate the through-holes and holding portions for holding lower ends of the articles;

retaining and positioning the articles relative to the bottom-rest member of the article delivery box by a box supply member having a positioning member for performing positioning by acting upon the projections of the bottom-rest member; and successively extracting the articles by article extracting means after the articles have been position and retained.

2. The method according to claim 1, wherein supplied article delivery boxes further include:

partitioning members for partitioning the articles individually within said outer box, and an upper-end supporting member, which has grooves for holding the partitioning members at a prescribed equidistant spacing, attached to an inner peripheral wall of said outer box.

3. The method according to claim 2, further comprising a box manufacturing step before the continuous supply step, said box manufacturing step comprising attaching the partitioning members and an upper-end supporting member to the outer box in conformity with external dimensions of the articles, wherein the upper-end support member has grooves for holding the partitioning members at different prescribed spacings and is attached to an inner peripheral wall of the outer box.

4. An article supply method using an article delivery box for accommodating a plurality of comparatively long parts of a cartridge unit, which is used in an image forming apparatus, in an upright attitude and supplying the parts to a prescribed working location, said method comprising the steps of:

supplying article delivery boxes to continuous supply means supplying the article delivery boxes to the prescribed working location one box at a time, wherein each article delivery box includes an outer box having a bottom portion, which is formed to include through-holes and an upper side which is open, and a bottom-rest member laid upon a bottom surface of the outer box and formed to have projections that penetrate the through-holes and holding portions for holding lower ends of the comparatively long parts;

retaining and positioning the comparatively long parts relative to the bottom-rest member of the article delivery box by a box supply member having a positioning member for performing positioning by acting upon the projections of the bottom-rest member; and successively extracting the comparatively long parts by article extracting means after the parts have been positioned and retained.

5. The method according to claim 4, wherein the supplied article delivery boxes further include:

partitioning members for partitioning the comparatively long parts individually within the outer box; and an upper-end supporting member, which has grooves for holding the partitioning members at a prescribed equidistant spacing, attached to an inner peripheral wall of the outer box.

6. The method according to claim 4, further comprising a box manufacturing step ahead of said continuous supply step, said box manufacturing step comprising attaching the partitioning members and an upper-end supporting member to the outer box in conformity with external dimensions of the comparatively long parts, wherein the upper-end support member has grooves for holding the partitioning members at different prescribed spacings and is attached to an inner peripheral wall of the other box.

7. An article delivery box for accommodating a plurality of comparatively long articles in an upright attitude and supplying the articles to a prescribed working location, comprising:

an outer box having a bottom portion, which is formed to include through-holes, and an upper side which is open;

a bottom-rest member laid upon a bottom surface of said outer box and formed to have projections that penetrate the through-holes and holding portions for holding lower ends of the articles;

partitioning members for partitioning the articles individually within said outer box; and an upper-end supporting member, which has grooves for holding said partitioning members at a prescribed equidistant spacing, attached to an inner peripheral wall of said outer box.

8. The article delivery box according to claim 7, wherein said upper-end support member is capable of being attached to and detached from said outer box.

9. The article delivery box according to claim 7, wherein guide holes for positioning said bottom-rest member accurately with respect to the prescribed working location are provided at said projections.

10. An article delivery box for accommodating a plurality of comparatively long articles in an upright attitude and supplying the articles, having a first width, to a prescribed working location, comprising:

an outer box having a bottom portion including through-holes and an upper side which is open;

a bottom-rest member laid upon a bottom surface of said bottom portion and having projections that penetrate the through-holes, retaining partitioning members separated by a second width, and holding portions for holding lower ends of the articles;

said bottom-rest member having a prescribed shape formed from a body for restoring the articles to a normal attitude when the articles fall over from the normal accommodated attitude, wherein the articles are disposed between said partition members in a generally upright attitude and are restricted to tilt laterally no greater than:

(second width−first width)/2.

11. An article delivery box for accommodating a plurality of comparatively long parts of a cartridge unit, which is used in an image forming apparatus, in an upright attitude and supplying the articles to a prescribed working location, comprising:

an outer box having a bottom portion, which is formed to include through-holes, and an upper side which is open;

a bottom-rest member laid upon a bottom surface of said outer box and formed to have projections that penetrate the through-holes and holding portions for holding lower ends of the comparatively long parts;

partitioning members for partitioning the comparatively long parts individually within said outer box; and an upper-end supporting member, which has grooves for holding said partitioning members at a prescribed equidistant spacing, attached to an inner peripheral wall of said outer box.

12. An article delivery box for accommodating a plurality of comparatively long parts of a cartridge unit, which is used in an image forming apparatus, in an upright attitude and supplying the articles to a prescribed working location, comprising:

an outer box consisting of a resin material and having a bottom portion, which is formed to include through-holes, and an upper side which is open;

a bottom-rest member, which consists of a prescribed resilient body, laid upon a bottom surface of said outer box so as to be free to move up and down and formed to have projections that penetrate the through-holes and holding portions for holding lower ends of the comparatively long parts;

partitioning members for partitioning the comparatively long parts individually within said outer box; and an upper-end supporting member, which has grooves for retaining said partitioning members at a prescribed equidistant spacing, attached to an inner peripheral wall of said outer box in a freely detachable manner.

13. An article supply method using an article delivery box for supplying different article delivery boxes, each of which accommodates a plurality of articles, to a prescribed working location of a robot apparatus, comprising the steps of:

continuously supplying article delivery boxes that differ from one another to continuous supply means for supplying the boxes to the prescribed working location one box at a time, each article delivery box including an outer box having a bottom portion formed to include through-holes of a pitch that differs from one article delivery box to another and an upper side which is open, and a bottom-rest member laid upon a bottom surface of the outer box and formed to have projections that penetrate the through-holes and holding portions for holding lower ends of the articles;

discriminating the type of article delivery box;

positioning and retaining the articles relative to the bottom-rest member of the article delivery box by a box supply member having pitch changing means for changing pitch spacing in dependence upon the pitch of the projections of the bottom-rest member; and successively extracting the articles by the robot apparatus after the articles have been positioned and retained.

* * * * *

UNITED STATES PATENT AND TRADEMARK OFFICE

CERTIFICATE OF CORRECTION

PATENT NO. : 5,427,222

DATED : June 27, 1995

INVENTOR(S) : Miura et al.

It is certified that error appears in the above-indentified patent and that said Letters Patent is hereby corrected as shown below:

COLUMN 12:

Line 16, "position" should read --positioned--.
Line 18, "sup-" should read --the sup- --.

Signed and Sealed this

Twenty-first Day of November, 1995

Bruce Lehman

*Attest:*

BRUCE LEHMAN

*Attesting Officer*

*Commissioner of Patents and Trademarks*